US011606986B2

(12) United States Patent
Chan

(10) Patent No.: US 11,606,986 B2
(45) Date of Patent: Mar. 21, 2023

(54) CORD SECURING SYSTEM

(71) Applicant: Duraflex Hong Kong Limited, Hong Kong (CN)

(72) Inventor: Yick Fai Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 318 days.

(21) Appl. No.: 16/861,302

(22) Filed: Apr. 29, 2020

(65) Prior Publication Data

US 2021/0337895 A1 Nov. 4, 2021

(51) Int. Cl.
*A41D 13/11* (2006.01)

(52) U.S. Cl.
CPC ..... *A41D 13/1161* (2013.01)

(58) Field of Classification Search
CPC ..... A41D 13/1161; A42B 1/24; A42B 7/00; A42B 3/085; A44B 11/12
USPC ..... 128/205.25; 2/421
See application file for complete search history.

(56) References Cited

U.S. PATENT DOCUMENTS 5,469,583 A * 11/1995 Akeley ..... A42B 3/08 24/191
6,341,382 B1 * 1/2002 Ryvin ..... A42B 3/145 2/418
9,021,835 B2 * 5/2015 Babyak ..... G04B 47/042 63/29.1
10,405,612 B1 9/2019 Chan
11,351,323 B2 * 6/2022 Bearne ..... A61M 16/0683
2005/0103344 A1 * 5/2005 Cheng ..... A41D 13/1161 128/206.13
2007/0245467 A1 * 10/2007 Lilenthal ..... A42B 3/225 2/416
2009/0055999 A1 * 3/2009 Garcia ..... A44B 11/001 24/265 R (Continued)

FOREIGN PATENT DOCUMENTS

CN 203 763 695 U 8/2014
JP 2011-004910 A 1/2011

(Continued)

OTHER PUBLICATIONS

International Search Report in PCT/CN2021/090267, dated Jul. 22, 2021.

(Continued)

*Primary Examiner* — Timothy K Trieu
(74) *Attorney, Agent, or Firm* — Collard & Roe, P.C.

(57) ABSTRACT

A securing device that allows adjustable securing of a face mask, face shield or goggles to a wearer's head is formed from a first portion having a strap, a first end with a securing button and a connecting element, and a second portion having a strap, a first end with a securing button and a connecting receptacle for interacting with the connecting element to connect the two straps together. The securing buttons are formed from a top plate connected to a bottom plate via a connecting leg having a cross section with an acute angle. The bottom plate has slits extending from an outer edge to the connecting leg on both sides of the acute angle, such that a cord is securable to the securing button by inserting the cord into one of the slits, wrapping the cord around the acute angle of the connecting leg and exiting from the other of the slits.

10 Claims, 9 Drawing Sheets

(56) References Cited

U.S. PATENT DOCUMENTS

| | | | | |
|---|---|---|---|---|
| 2014/0096310 | A1* | 4/2014 | Szalkowski | A42B 3/145 2/421 |
| 2014/0174447 | A1* | 6/2014 | Ho | A61M 16/0683 128/205.25 |
| 2020/0093212 | A1* | 3/2020 | Zheng | A41D 13/1161 |

FOREIGN PATENT DOCUMENTS

| | | | |
|---|---|---|---|
| JP | 2011-115449 | A | 6/2011 |
| JP | 3-200050 | U | 10/2015 |
| WO | WO2020/053786 | * | 3/2020 |

OTHER PUBLICATIONS

Written Opinion of the International Searching Authority in PCT/CN2021/090267, dated Jul. 22, 2021.

* cited by examiner

CORD SECURING SYSTEM

BACKGROUND OF THE INVENTION

1. Field of the Invention

This invention relates to a securing system for adjustably securing two or more cords, or two loops of cords together. In particular, the invention relates to a securing system that is useful in securing the loops or strings of face shields or face masks, particularly surgical masks, or goggles, in place while the mask is being worn.

2. The Prior Art

Surgical face masks often have a closed loop formed of a single cord on each side of the mask for securing the mask to a wearer's face. The mask is secured on a wearer by hooking the loops over the wearer's ears. This can be an effective and simple method, but can also lead to discomfort from the pressure of the cords, which are usually elastic, on the back of the wearer's ears. In addition, the masks are generally manufactured in only a single size, which may not fit the wearer. Another type of mask has two cords on each side of the mask. These cords are tied to the corresponding cord on the other side of the mask, at the back of the wearer's head. These cords are usually not elasticized, and it can often be difficult to tie them with enough tension to keep the mask properly in place and yet comfortable. It would be desirable to have a device that attaches to the cords and/or loops on the face mask, face shield or goggles, which can secure them together on a wearer's head in an easy-to-use and adjustable manner, so that they can be worn safely and comfortably.

SUMMARY OF THE INVENTION

This object is accomplished by a device for securing cords that is formed from a first portion and a second portion that are adjustably connected together. The first portion is formed from a strap, a first end with a securing button for attachment to a cord, and a connecting element, and the second portion is formed from a strap, a first end with a securing button for attachment to a cord, and a connecting receptacle configured to interact with the connecting element on the first portion to connect the strap of the first portion with the strap of the second portion in an adjustable manner.

Each of the securing buttons on the first and second portions is formed from a top plate connected to a bottom plate via a connecting leg having a cross section with at least one acute angle. The bottom plate has slits extending from an outer edge of the bottom plate to the connecting leg on both sides of the acute angle. A cord is securable to the securing button by inserting the cord into one of the slits, wrapping the cord around the acute angle of the connecting leg and exiting from the other of the slits. The friction produced by the cord being bent around the slits and around the acute angle of the connecting leg prevent the cord from slipping once it is in position, so that the securing button holds the cord in place. The slits can be sized so as to correspond with a width of a standard cord on a surgical mask or even smaller, so as to add additional friction on the cord when in place. When cords are connected to the securing buttons on both the first portion and the second portion, the tension on the cords can be adjusted by adjusting the position of the connecting element on one strap in relation to the connecting receptacle on the other strap, without having to adjust the cords themselves at all.

The securing buttons can be configured so that the acute angle faces a rear side of the securing button, and the top plate and bottom plate are directly connected to each other at a front side of the securing button. The cord approaches the slits from underneath the bottom plate, enters the space between the top and bottom plate via the slits, and wraps around the acute angle of the connecting leg. The slits themselves can be configured to be V-shaped, adding yet additional acute angles through which the cord travels, thus reducing the chance of slippage during use. The V-shape also prevents the cords from exiting the connecting buttons even when there is slack in the cords. The securing buttons can be configured integrally with the straps, via unitary molding procedure, or can be attached to the strap via any conventional method.

In one embodiment, which accomplishes the adjustability in a simple and effective manner, the connecting element comprises at least one protrusion and the connecting receptacle comprises at least one aperture configured to secure the protrusion therein. A series of protrusions and apertures along the first and second straps allows the user to easily adjust the straps to the correct length. The protrusions have end portions that are sized to be slightly larger than the protrusions In another embodiment, a ratchet system can be used to adjust the position of the straps relative to each other. This ratchet system can be any suitable ratchet system, but a preferred system is the one disclosed in U.S. Pat. No. 10,405,612, the disclosure of which is herein incorporated by reference. In this system, the connecting receptacle comprises a housing having a bottom, two side walls, an elastic arm connected to each one of the side walls, a front opening and a rear opening, and a cam lid rotatably connected to the side walls of the housing. The cam lid has a top, a bottom, two side walls, an interior cavity, a front opening, a rear opening, and at least one locking element disposed in the interior cavity. The connecting element on the first portion comprises a ratchet system on the strap of the first portion, the ratchet system consisting of a plurality of teeth extending along a length of the strap. The cam lid is configured to lock the strap of the first portion to the housing when the strap of the first portion is fed through the openings in the front and rear of the housing and cam lid such that the at least one locking element on the cam lid engages at least one of the teeth of the ratchet stem. Pressing the elastic arms of the housing toward each other causes the elastic arms of the housing to press against the sides of the cam lid and rotate the cam lid to release the at least one locking element from the at least one of the teeth of the ratchet system. This system is particularly useful as the user can easily adjust the straps while a mask or face shield is being worn, as it is not necessary to visualize the structure during adjustment. The user simply has to reach behind their head and place their fingers on the elastic arms of the housing to release the ratchet system. The straps can be tightened simply by forcing the strap with the ratchet system more deeply into the connecting receptacle.

In another embodiment, each of the straps is set up to hold two cords, or a loop of a cord in two positions. In this embodiment, the first ends of the first portion and the second portion comprise a hinge connected to two rotatable arms, each arm having a free end with one of the securing buttons disposed thereon, so that each strap has two securing buttons. The arms can be placed in a desired position for holding two separate cords, or two positions on a cord loop. In one embodiment, the hinge is configured so as to keep the arms in place, so that the arms stay in a set position when not exposed to a force, yet the position of the arms can be changed by applying a force that exceeds the frictional resistance of the hinge. The hinge can be formed of a post on one of the arms that snaps into an aperture in the other arm. The aperture can have a variegated circumference to provide resistance to rotation of the post, particularly if the post has a polygonal cross-section.

The securing device according to the invention is especially useful for securing a face mask, such as a surgical mask, or a face shield, to a user's face. It can also be used to secure goggles or other eyewear. In an embodiment of the securing device in which each of the straps has a single securing button, the securing device can be used to secure a mask or shield having two side edges, and cords connected to the side edges with one end of each cord connected at a top section of each side edge and the other end of each cord connected at a bottom section of each side edge so as to form a loop on each side of the face-covering portion. One of the loops is secured in the securing button of the first portion and the other of the loops is secured in the securing button of the second portion. The straps are connected to each other at the back of the user's head, and the fit of the mask or shield on the user can be adjusted by adjusting the position of the straps relative to each other without needing to adjust the cord loops themselves. In addition, the securing device according to the invention eliminates the discomfort caused by the cord loops pressing on the back of the ears of the wearer, which is common occurrence during conventional use of these masks.

The embodiment of the invention where each of the first and second portions are connected to two securing buttons can be used with a variety of masks, face shields or goggles. In the mask described above, the one loop on each side of the mask is secured in both of the securing buttons on each side. This prevents compression of the face-covering portion of the mask because each side of the loop is kept spaced apart due to the spatial separation of the securing buttons on each side. This embodiment can also be used with a mask or face shield having two cords connected to the side edges, with one cord connected at a top section of each side edge and another cord connected at a bottom section of each side edge. With this type of mask or face shield, the cords at the top and bottom sections of one of the side edges are secured in the securing buttons of the first portion and the cords at the top and bottom of the other side edge are secured in the securing buttons of the second portion. The securing device according to the invention eliminates the need to tie the cords together at the back of the wearer's head, and allows for easy adjustment of the mask without the need to adjust the cords themselves.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
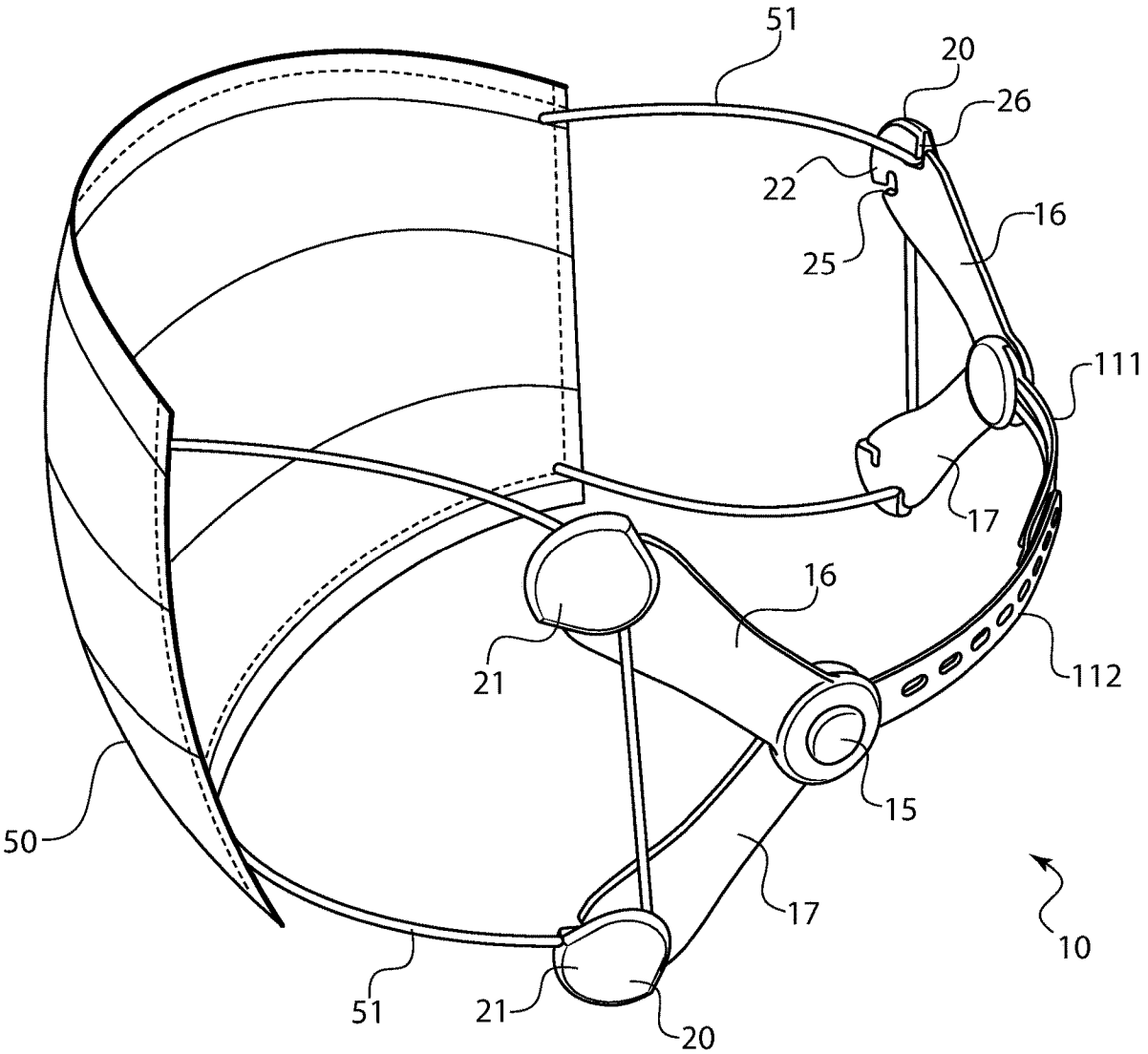
FIG. 1 shows a first embodiment of the device according to the invention in use on a surgical mask.
Figure 2:
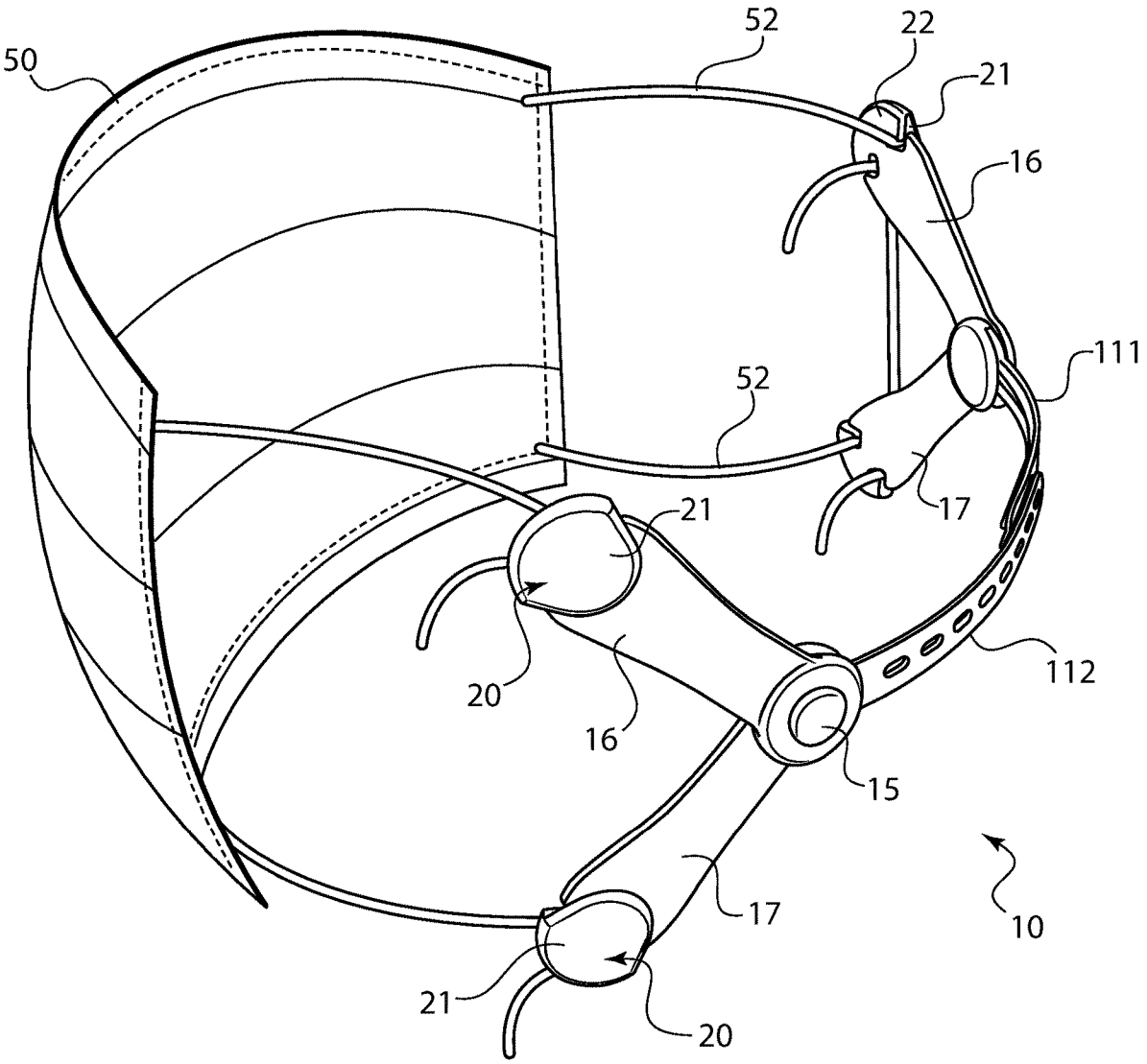
FIG. 2 shows the device according to the invention in use on the mask with a different cord arrangement.
Figure 3:
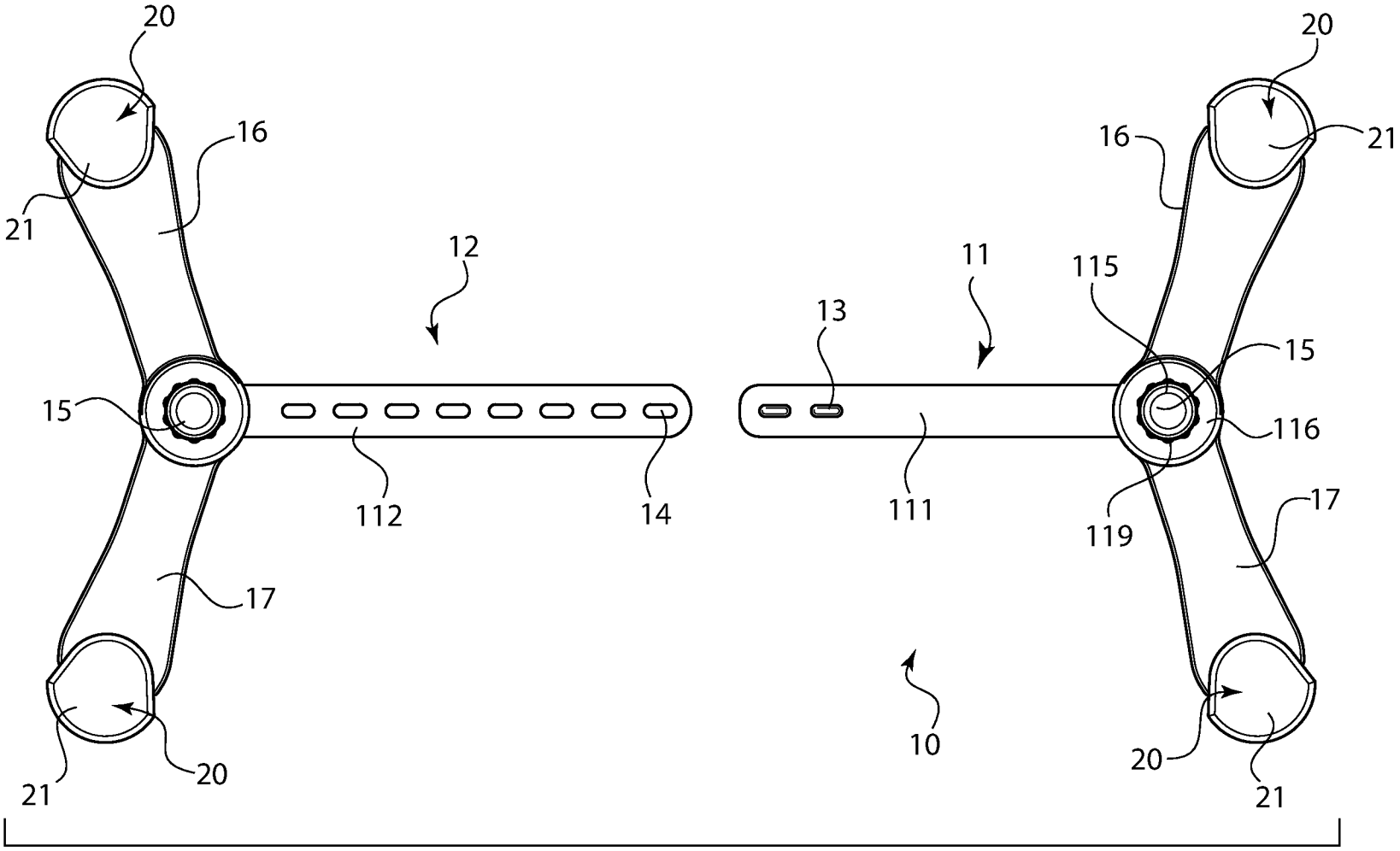
FIG. 3 shows the device according to the invention in a separated state.
Figure 5:
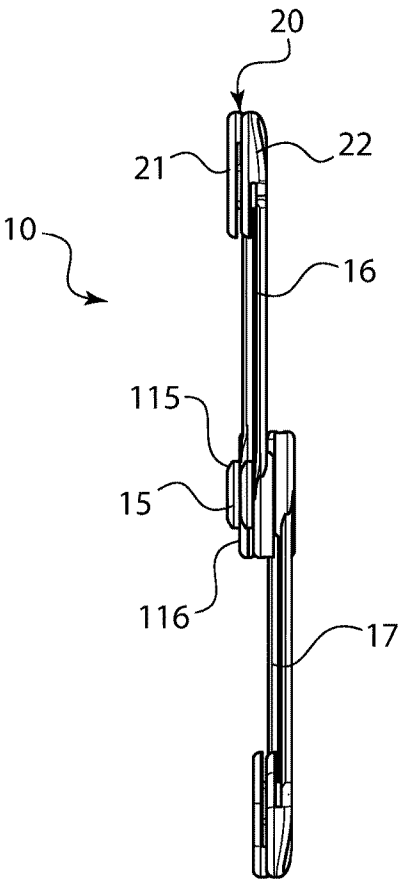
FIG. 5 shows a top view of the assembled device.
Figure 4:
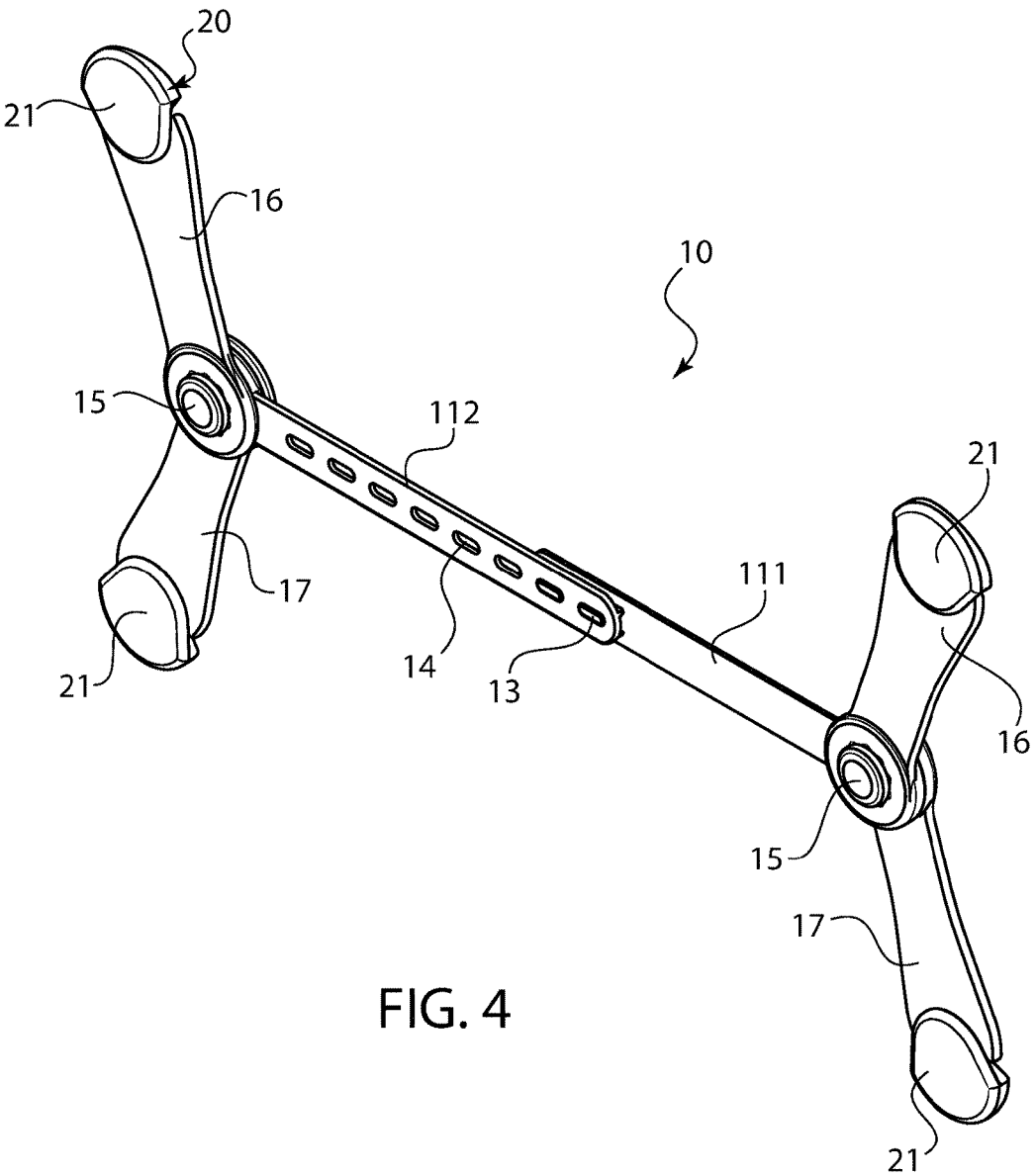
FIG. 4 shows the device according to the invention as assembled.

Referring now in detail to the drawings, FIGS. 1 and 2 show a first version of the securing device 10 according to the invention on a surgical mask 50 having two different cord arrangements 51, and 52, respectively. As further shown in FIGS. 3-5, device 10 consists of a first portion 11 and a second portion 12. First portion 11 has a strap 111 that is adjustably connected to a strap 112 on second portion 12. As shown in FIGS. 3-5, first portion 11 is secured to second portion 12 by a plurality of protrusions 13 on strap 111 that can be inserted into apertures 14 on strap 112. Protrusions 13 are shaped so as to have at least one portion that is slightly wider than the width of apertures 14 so that protrusions 13 snap into apertures 14 and cannot be removed without applying additional force. There are sufficient apertures 14 so as to allow the user to adjust the combined length of straps 111 and 112 to comfortably fit the size of the user's head.

Each end of first portion 11 and second portion 12 have a strap securing device in the form of two arms 16, 17 connected by a hinge 15, which allows arms 16, 17 to be positioned at any desired angle. The structure and operation of hinge 15 will be discussed with reference to FIGS. 7-9 below. Connected to the end of each arm 16, 17 is a securing button 20, which can be integrally formed with arms 16, 17 or formed as a separate piece.

Figure 6:
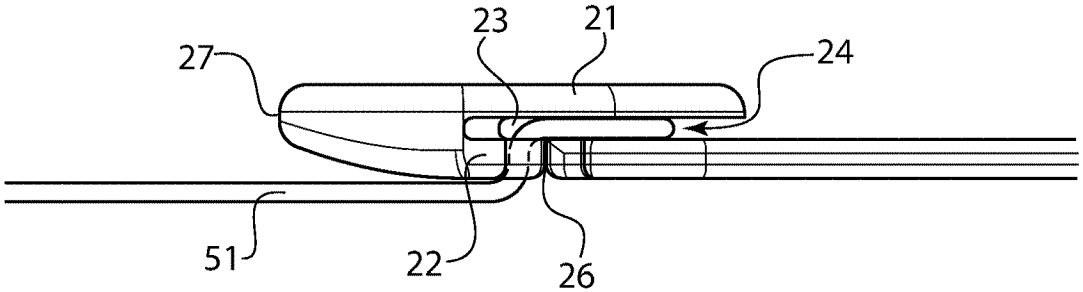
FIG. 6 shows a side view of the securing button with a cord threaded therethrough.
Figure 7:
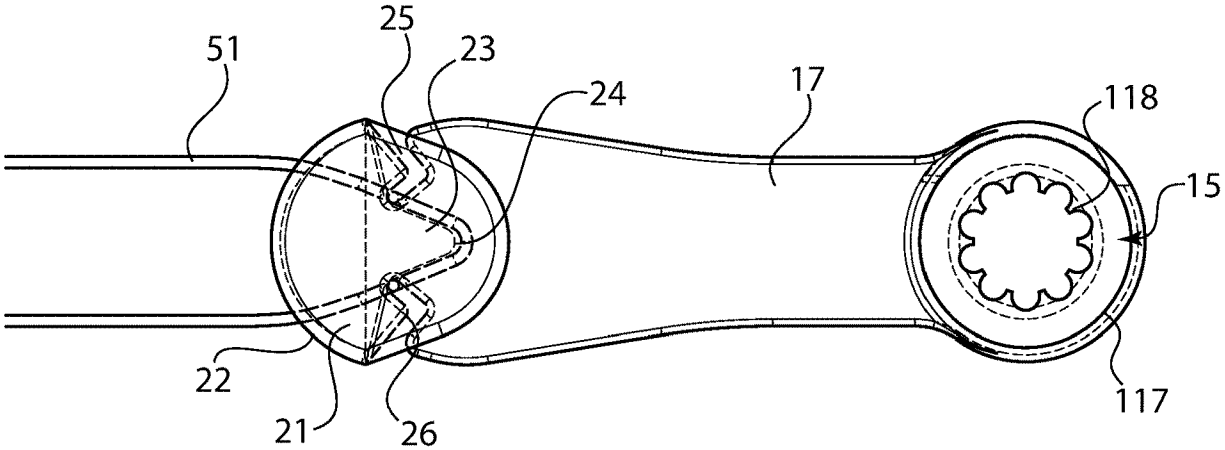
FIG. 7 shows a top view of the securing button on one of the arms with interior portions in broken lines.
Figure 8:
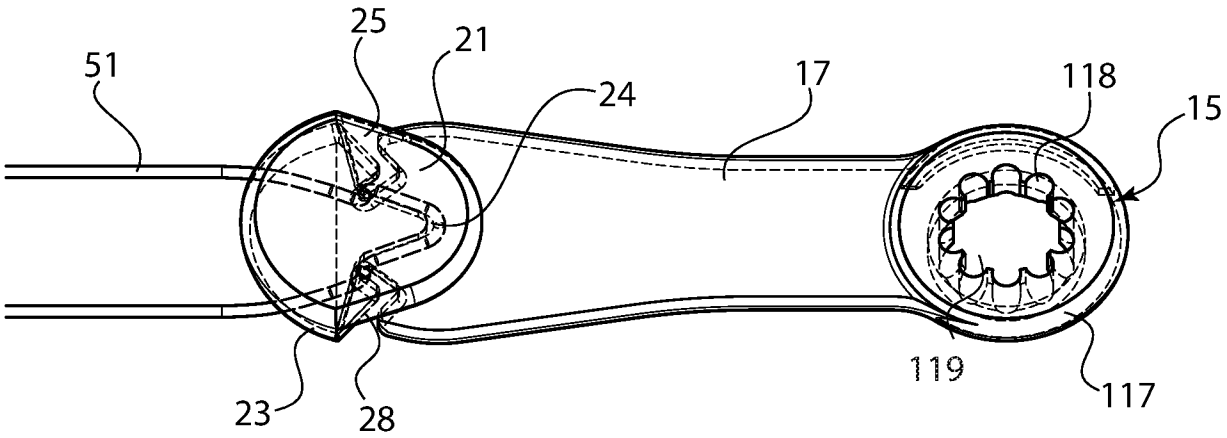
FIG. 8 shows a top and side view of the securing button of FIG. 7 with a cord threaded therethrough.
Figure 9:
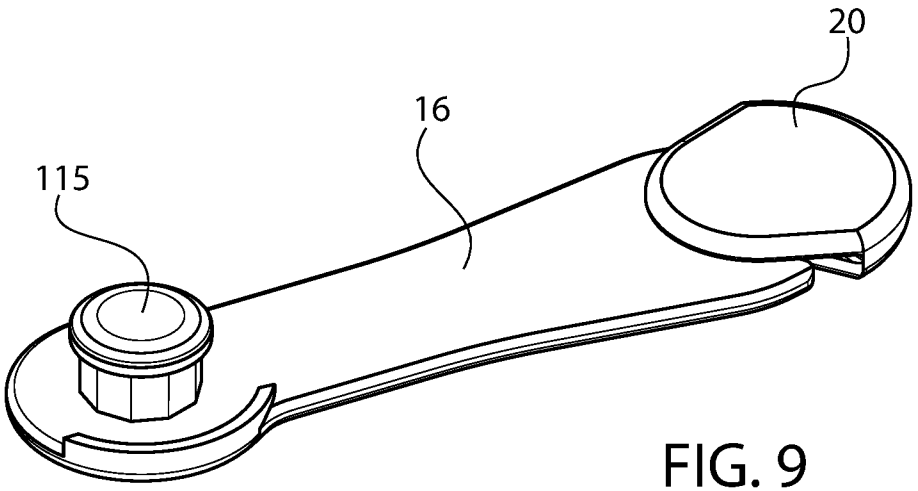
FIG. 9 shows the other arm for connection to the arm shown in FIGS. 7 and 8.

As shown in FIGS. 1-5 and in more detail in FIGS. 6-8, each securing button comprises a top plate 21 connected to a bottom plate 22 via a connecting leg 23 having a cross section with at least one acute angle 24. Bottom plate 22 has slits 25, 26 extending from an outer edge of the bottom plate to the connecting leg on both sides of the at least one acute angle, such that a cord 51 is securable to the securing button by inserting the cord into one of the slits 25, wrapping the cord around the acute angle 24 of the connecting leg 23 and exiting from the other of the slits 26. As shown in FIG. 6 and in a perspective view in FIG. 8, cord 51 is bent upward from underneath bottom plate 22 as it enters the slits and wraps around acute angle 24 of connecting leg 23. It is then bent downward again as it exits slit 26 to extend back below bottom plate 22. The multiple bending angles of the cord 51, and particularly acute angle 24, keep cord 51 in place due to frictional resistance of the bent portions on the cord 51. As also shown in FIG. 6, the end 17 of securing button 20 has top plate 21 and bottom plate 22 connected together, and the opposite end has top plate open around connecting leg 23, so that cord 51 can be wrapped around acute angle 24 without having to thread it through a narrow channel.

As shown in FIG. 7, slits 25, 26 can be configured to be V-shaped, which prevents cord 51 from inadvertently becoming disengaged from securing button 20 during use, even if there is slack on cord 51.

The securing buttons 20 can be used to secure cord 51, which is in the form of a loop, in two different places along the loop, as shown in FIG. 1. Alternatively, securing buttons 20 can be used to secure individual cords 52 on mask 50, as shown in FIG. 2, or on a face shield (not shown). The device 10 according to the invention can be connected to mask 50, either via cords 52 or 51, and then placed on the wearer's head and adjusted by adjusting the position of straps 111 and 112 relative to each other while mask 50 is being worn. This eliminates the need to adjust individual cords while in use. In the embodiment of FIG. 1, the device 10 according to the invention also alleviates the discomfort caused by positioning the loops of cord 51 around the wearer's ears.

The configuration of hinge 15 can be any preferred configuration. One configuration is shown in FIGS. 3-5, with the separated portions shown in FIGS. 7-9. As can be seen, hinge 15 consists of a post 115 formed integrally with arm 16 and extending through a plate 117 on arm 17, having a variegated aperture 119 to connect arms 16 and 17 together. The variegated sidewall of socket 118 around aperture 119 on plate 116 creates a resistance to rotation of the post 115, which have a polygonal cross-section, so that the arms can be positioned in a desired arrangement and stay in place until enough force is generated to move the arms around post 115.

Figure 10:
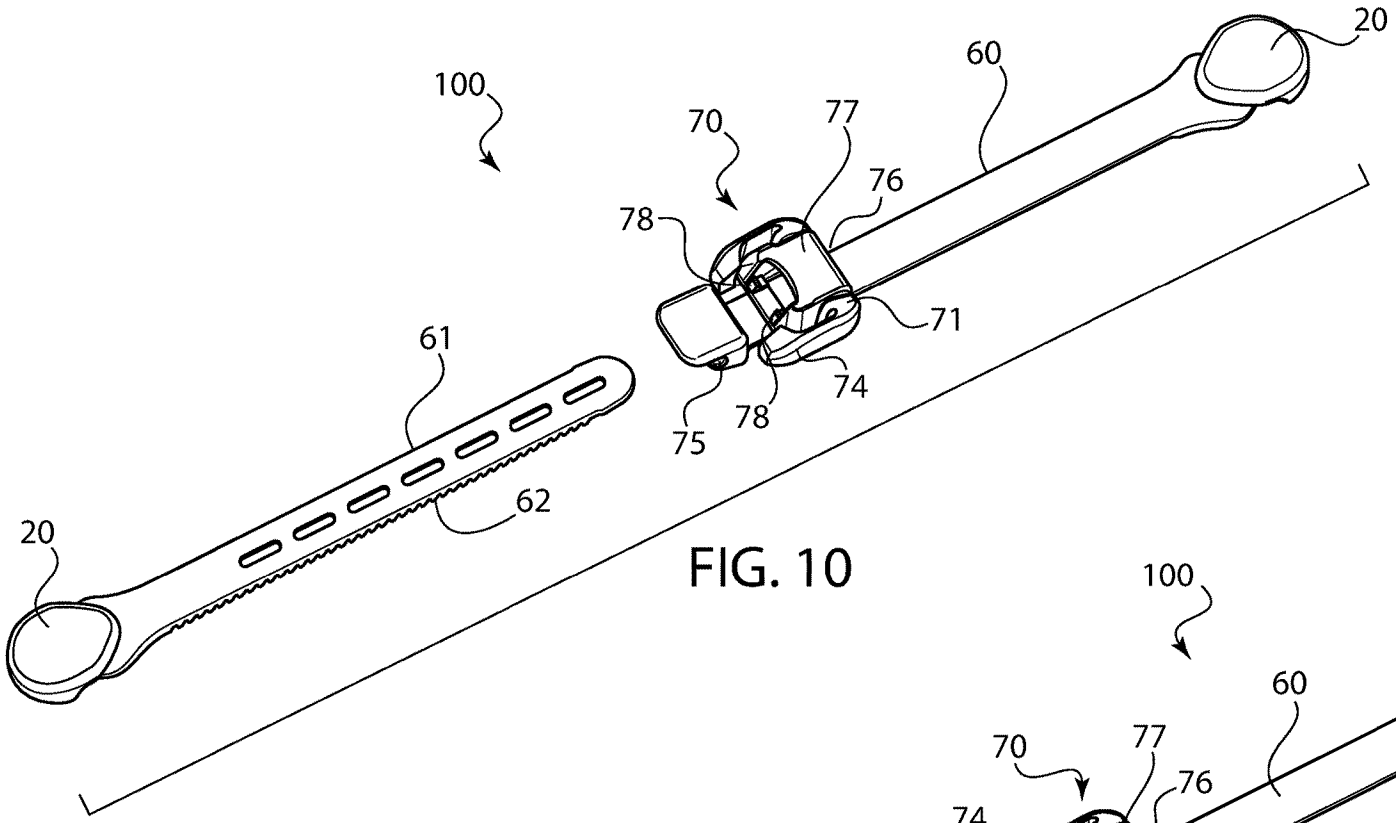
FIG. 10 shows a second embodiment of the securing device according to the invention.
Figure 11:
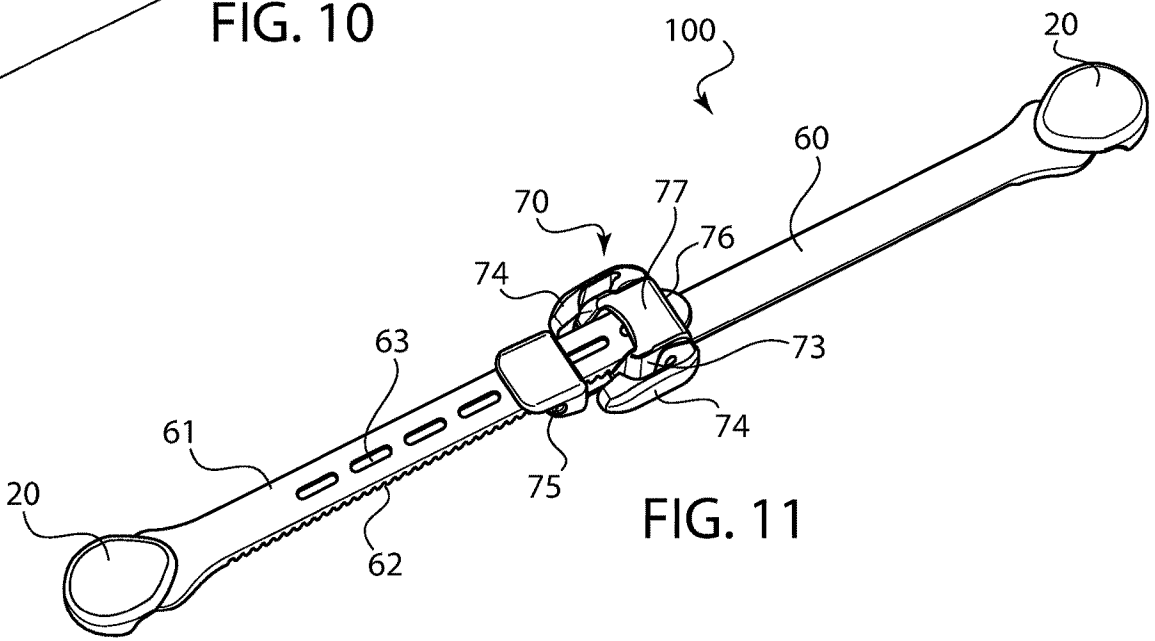
FIG. 11 shows a top view of the device of FIG. 10.
Figure 12:
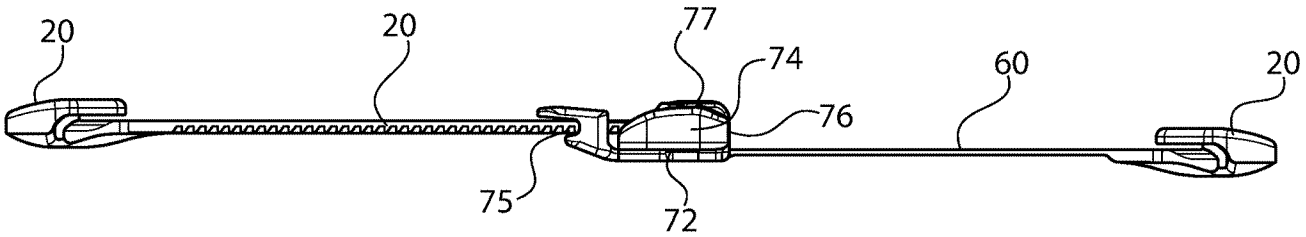
FIG. 12 shows a side view of the device of FIG. 10.

A second embodiment of the securing device 100 according to the invention is shown in FIGS. 10-14. FIG. 10 shows the securing device 100 in a disassembled state, and FIG. 10 shows the device 100 as assembled. In this embodiment, strap 60 is connected to a ratchet securing mechanism 70 on one end, and securing button 20 on the other end. Securing button 20 is identical to securing button 20 on the device as shown in FIGS. 1-9.

Figure 14:
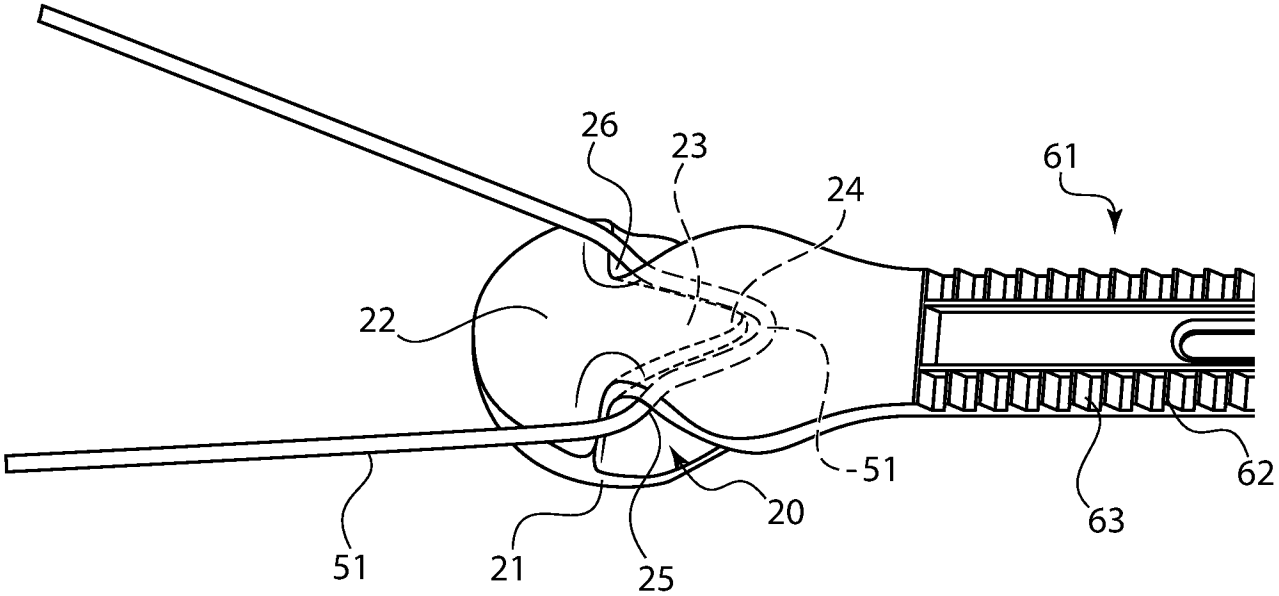
FIG. 14 shows a rear view of the securing button in the device of FIG. 10.

Strap 61 is also connected to a securing button on one end, and has a ratchet system 62 formed of a plurality of teeth 63 running along its underside (see FIG. 14). Ratchet securing mechanism 70 is disclosed in detail in U.S. Pat. No. 10,405,612, the disclosure of which is herein incorporated by reference, and consists of a housing 71 having a bottom 72, two side walls 73, an elastic arm 74 connected to each one of the side walls, a front opening 75 and a rear opening 76. A cam lid 77 is rotatably connected to the side walls 73 of the housing. The cam lid has an interior cavity, a front opening, a rear opening, and at least one locking element 78 disposed in the interior cavity. The cam lid 77 is configured to lock the strap 61 to the housing 71 when the strap 61 is fed through the openings in the front and rear of the housing 71 and of the cam lid 77 such that the at least one locking element 78 engages at least one of the teeth 63 of the ratchet system 62. Once engaged, the strap 61 cannot be pulled backward out of the ratchet securing mechanism 70. To release strap 61, the user presses the elastic arms 74 of the housing 71 toward each other, which causes the elastic arms 74 of the housing to press against the sides of the cam lid 77 and rotate the cam lid 77 downward to release the locking elements 78 from at least one of the teeth 63 of the ratchet system 62. At this point, strap 61 can be pulled away from ratchet securing mechanism 70 to remove or readjust the position of the straps.

Alternatively, any other known ratchet securing devices could also be used to ensure adjustability of straps 60, 61 relative to each other.

Figure 13:
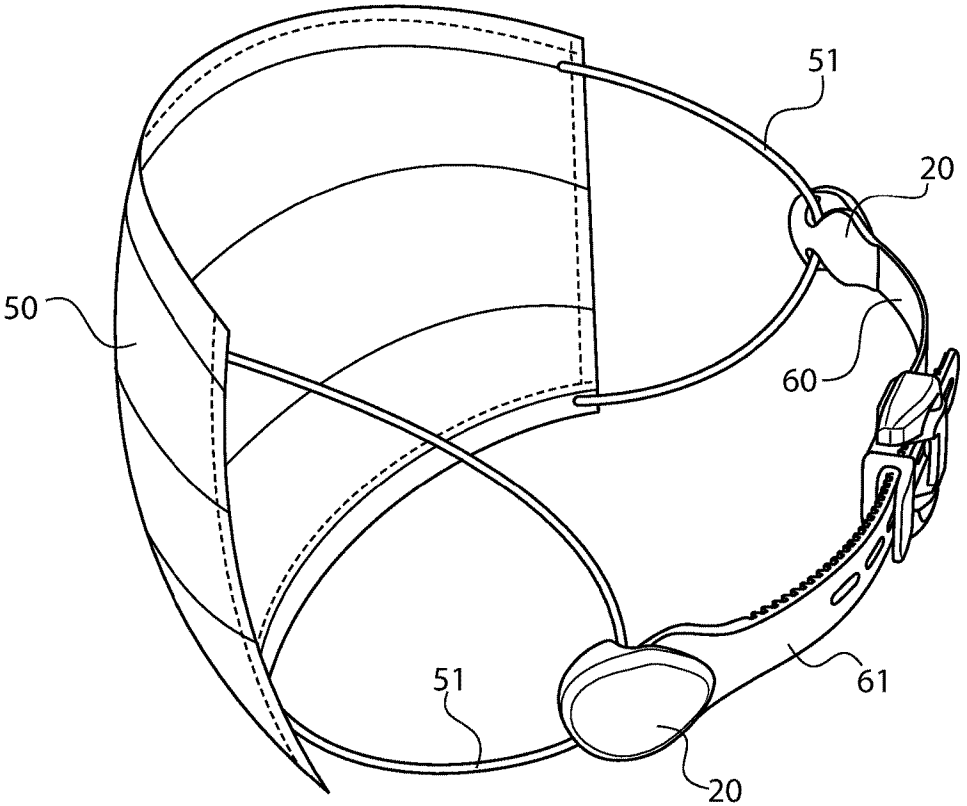
FIG. 13 shows the device of FIG. 10 in use on a surgical mask.

To use securing device 100 on face mask 50, securing buttons 20 are secured to cords 51 of mask 50, as shown in FIG. 13, in the same manner as described with respect to the embodiment of FIGS. 1-9. The only difference is that here, there is only one securing button 20 for each loop of cord 51. In securing device 100, securing buttons 20 are connected directly to straps 60, 61, without the use of rotatable arms. The wearer connects cords 51 to securing buttons 20 prior to placing the mask 50 on their head. Then, once the mask 50 is in position, adjustment is made by moving strap 61 through ratchet securing mechanism 70 until the desired fit is achieved.

A rear view of securing button 20 on strap 61 having ratchet mechanism 62 is shown in FIG. 14. As can be seen, cord 51 enters the space between top plate 21 and bottom plate 22 through slits 25, 26, where it travels around acute angle 24 of connecting leg 23 to secure cord 51 to securing button 20.

The present invention provides a simple and effective way to secure a face mask or face shield in an adjustable and comfortable manner. By making the mask or shield adjustable to the user's head size, it reduces discomfort, slippage and the need for the user to touch the mask for readjustment during use.

Accordingly, while only a few embodiments of the present invention have been shown and described, it is obvious that many changes and modifications may be made thereunto without departing from the spirit and scope of the invention.

What is claimed is:

1. A securing device comprising: a first portion having a strap, a first end with a securing button, and a connecting element, and a second portion having a strap, a first end with a securing button, and a connecting receptacle configured to interact with the connecting element on the first portion to connect the strap of the first portion with the strap of the second portion, wherein the securing buttons on the first and second portions each comprises a top plate connected to a bottom plate via a connecting leg having a cross section with at least one acute angle, wherein the bottom plate has slits extending from both sides of the at least one acute angle through opposite outer edges of the bottom plate, such that a cord is securable to the securing button by inserting the cord into one of the slits, wrapping the cord around the acute angle of the connecting leg and exiting from the other of the slits; wherein the first ends of the first portion and the second portion comprise a hinge connected to two rotatable arms, each rotatable arm having a free end with a securing button disposed thereon.

2. The securing device according to claim 1, wherein the connecting element comprises at least one protrusion and the connecting receptacle comprises at least one aperture configured to secure the protrusion therein.

3. The securing device according to claim 1, wherein the connecting element comprises a ratchet system on the strap of the first portion, the ratchet system consisting of a plurality of teeth along a length of the strap, and wherein the connecting receptacle comprises a ratchet securing device configured for engaging the teeth of the ratchet system.

4. The securing device according to claim 3, wherein the ratchet securing device comprises a housing having a bottom, two side walls, an elastic arm connected to each one of the side walls, a front opening and a rear opening, and a cam lid rotatably connected to the side walls of the housing, the cam lid having a top, a bottom, two side walls, an interior cavity, a front opening, a rear opening, and at least one locking element disposed in the interior cavity, wherein the cam lid is configured to lock the strap of the first portion to the housing when the strap of the first portion is fed through the openings in the front and rear of the housing and cam lid such that the at least one locking element engages at least one of the teeth of the ratchet system, and wherein pressing the elastic arms of the housing toward each other causes the elastic arms of the housing to press against the sides of the cam lid and rotate the cam lid to release the at least one locking element from at least one of the teeth of the ratchet system.

5. The securing device according to claim 1, wherein the hinge is configured so that the arms stay in a set position when not exposed to a force.

6. The securing device according to claim 1, wherein the acute angle faces a rear side of the securing button, and wherein the top plate and bottom plate are directly connected to each other at a front side of the securing button.

7. The securing device according to claim 1, wherein the slits are V-shaped.

8. The securing device according to claim 1, wherein the securing buttons are integrally formed with each of the straps.

9. A face-covering device comprising:

a face-covering portion having two side edges, cords connected to the side edges with one end of each cord connected at a top section of each side edge and the other end of each cord connected at a bottom section of each side edge so as to form a loop on each side of the face-covering portion, and a securing device comprising:

a first portion having a strap, a first end with a securing button, and a connecting element, and a second portion having a strap, a first end with a securing button, and a connecting receptacle configured to interact with the connecting element on the first portion to connect the strap of the first portion with the strap of the second portion, wherein the securing buttons on the first and second portions each comprises a top plate connected to a bottom plate via a connecting leg having a cross section with at least one acute angle, wherein the bottom plate has slits extending from both sides of the at least one acute angle to outer edges of the bottom plate, wherein one of the loops is secured in the securing button of the first portion and the other of the loops is secured in the securing button of the second portion by inserting the cord of each loop into one of the slits, wrapping the cord around the acute angle of the connecting leg and exiting from the other of the slits, wherein the first ends of the first portion and the second portion of the securing device comprise a hinge connected to two rotatable arms, each arm having a free end with one of the securing buttons disposed thereon, and wherein the loops are secured in both of the securing buttons on each side of the securing device.

10. A face-covering comprising: a face-covering portion having two side edges, cords connected to the side edges with one of the cords connected at a top section of each side edge and another cord connected at a bottom section of each side edge, and a securing device comprising: a first portion having a strap, a first end, and a connecting element, and a second portion having a strap, a first end, and a connecting receptacle configured to interact with the connecting element on the first portion to connect the strap of the first portion with the strap of the second portion, wherein the first ends of the first portion and the second portion comprise a hinge connected to two rotatable arms, each rotatable arm having a free end with a securing button disposed thereon, wherein the securing buttons on, the first and second portions each comprises a top plate connected to a bottom plate via a connecting leg having a cross section with at least one acute angle, wherein the bottom plate has slits extending from both sides of the at least one acute angle through opposite outer edges of the bottom plate, wherein the cords at the top and bottom sections of one of the side edges are secured in the securing buttons of the first portion and the cords at the top and bottom of the other side edge are secured in the securing buttons of the second portion by inserting each cord into one of the slits of a respective one of the securing buttons, wrapping the cord around the acute angle of the connecting leg and exiting from the other of the slits.

* * * * *